US006425981B1

(12) United States Patent
Jewitt

(10) Patent No.: US 6,425,981 B1
(45) Date of Patent: Jul. 30, 2002

(54) APPARATUS AND ASSOCIATED METHOD FOR DRYING A WET WEB OF PAPER

(75) Inventor: Dennis E. Jewitt, Kent (GB)

(73) Assignee: Metso Paper Karlstad Aktiebolg (AB), Karlstad (SE)

( * ) Notice: Subject to any disclaimer, the term of this patent is extended or adjusted under 35 U.S.C. 154(b) by 0 days.

(21) Appl. No.: 09/464,587

(22) Filed: Dec. 16, 1999

(51) Int. Cl.[7] ..... D21F 5/00; D21F 9/02

(52) U.S. Cl. ..... 162/207; 162/199; 162/109; 162/272; 162/381; 34/111; 34/116; 34/422

(58) Field of Search ..... 162/109, 111, 162/112, 113, 115, 116, 117, 118, 198, 199, 204, 206, 207, 272, 274, 275, 277, 278, 279, 281; 34/108, 111, 114, 115, 116, 117, 414, 419, 444, 422, 456, 425, 623–625; 134/15

(56) References Cited

U.S. PATENT DOCUMENTS

| | | | | | |
|---|---|---|---|---|---|
| 1,772,185 | A | * | 8/1930 | Liebeck | 162/111 |
| 2,537,129 | A | * | 1/1951 | Goodwillie | 162/290 |
| 3,629,056 | A | * | 12/1971 | Forrest | 162/305 |
| 4,172,007 | A | * | 10/1979 | Kankaanpaa | 162/206 |
| 4,911,791 | A | * | 3/1990 | Mokvist | 162/290 |
| 5,073,235 | A | | 12/1991 | Trokhan | 162/199 |
| 5,098,522 | A | | 3/1992 | Smurkoski et al. | 162/358 |
| 5,260,171 | A | | 11/1993 | Smurkoski et al. | 430/320 |
| 5,275,700 | A | | 1/1994 | Trokhan | 162/358.1 |
| 5,334,298 | A | | 8/1994 | Gegenwart | 204/192.12 |
| 5,364,504 | A | | 11/1994 | Smurkoski et al. | 162/116 |
| 5,426,867 | A | * | 6/1995 | Yli-Kauppila et al. | 34/452 |
| 5,529,664 | A | | 6/1996 | Trokhan et al. | 162/109 |
| 5,611,890 | A | | 3/1997 | Vinson et al. | 162/111 |
| 5,700,352 | A | | 12/1997 | Vinson et al. | 162/111 |
| 5,701,682 | A | | 12/1997 | Chuang et al. | 34/115 |
| 5,776,307 | A | | 7/1998 | Ampulski et al. | 162/117 |
| 5,863,386 | A | * | 1/1999 | Vuorinen et al. | 162/199 |
| 5,865,955 | A | * | 2/1999 | Ilvespaa et al. | 162/207 |
| 6,004,430 | A | * | 12/1999 | Ilvespaa et al. | 162/207 |
| 6,030,496 | A | * | 2/2000 | Baggot et al. | 162/111 |
| 6,134,804 | A | * | 10/2000 | Oechsle et al. | 34/114 |
| 6,189,233 | B1 | * | 2/2001 | Halmschlager et al. | 34/117 |

FOREIGN PATENT DOCUMENTS

| | | | |
|---|---|---|---|
| WO | WO 99/50499 | 10/1999 | D21F/5/00 |

* cited by examiner

*Primary Examiner*—Peter Chin
*Assistant Examiner*—Eric Hug
(74) *Attorney, Agent, or Firm*—Alston & Bird LLP

(57) ABSTRACT

An apparatus and associated method for drying a wet web of paper comprising a drying section for increasing the dry solids content of a wet web of paper, a cleaning section disposed at least not above the drying section, and a continuous drying fabric forming a loop at least about the drying section and the cleaning section. The fabric receives the web along an upper portion of the loop before the drying section, wherein the web is supported on an upper surface of the fabric. The fabric then transports the web through the drying section in a non-inverting web run to increase the dry solids content of the web before the web is separated from the fabric. Once web is separated from the fabric, the fabric travels through the cleaning section to be cleaned before returning to receive more of the wet paper web thereon.

24 Claims, 9 Drawing Sheets

APPARATUS AND ASSOCIATED METHOD FOR DRYING A WET WEB OF PAPER

FIELD OF THE INVENTION

The present invention relates to paper making machines and, more particularly, to an apparatus and associated method for drying a wet web of paper.

BACKGROUND OF THE INVENTION

Generally, in a paper making machine, a wet paper web is formed in a former on a carrying fabric and then moved downstream. As the web is transported downstream in the paper making machine with a drying fabric, it is processed through a dewatering or drying section where it is partially dewatered or dried. In some configurations of paper making machines, the carrying fabric may also comprise the drying fabric. In alternate configurations of paper making machines, the drying fabric may be a separate fabric from the carrying fabric where the formed paper web is transferred from the carrying fabric to the drying fabric for transportation through the dewatering or drying section.

The dewatering or drying section may include, for example, one or more of a through-air dryer (TAD), an infrared dryer, an impingement dryer, a cylindrical contact dryer, or the like. The web and fabric may then be passed downstream through a nip where the web is transferred to a Yankee dryer from the fabric. Generally, where a Yankee dryer follows the dryers in the preceding section, the dryers in the preceding section are regarded as pre-dryers for partially drying or dewatering the paper web. These pre-dryers may further be regarded as comprising a part of the drying section or collectively forming a separate pre-drying or dewatering section. The Yankee dryer is accordingly regarded as the final dryer for drying the paper web. However, where the paper making machine does not include a Yankee dryer, the dryers in the preceding section comprise the final dryers for drying the paper web.

As the paper web proceeds from the former to the final dryer, the processes therebetween often leave residue from the paper web on the fabric or fabrics used to transport the paper web through the paper making machine and, particularly, through the dewatering and/or drying section. Since fabrics used for transporting the web are typically configured as endless loops, they continuously cycle about the forming and/or drying processes as the paper is being produced and dried. Thus, for proper operation of the paper making machine, the web-carrying fabrics should be cleaned before they cycle back to receive more of the paper web to be transported through a particular process. Cleaning the fabric often consists of washing the fabric by passing it under a shower and then partially drying the fabric, for example, by passing it by a vacuum box. However, some special types of paper making processes involve special fabrics, such as TAD fabrics or other texturing fabrics used in tissue manufacturing which typically have an open structure and which also require cleaning through the entire thickness of the fabric, that require special and often complicated cleaning equipment.

A paper making machine thus generally comprises one or more fabrics carrying a paper web, a drying section where the web is dried by one or more dryers, a cleaning section where the fabric is cleaned before cycling back to receive more of the wet paper web from a web forming section, and a reel-up for receiving the dried paper web and winding it onto a spool. Accordingly, the paper making process is typically accomplished by having the drying section disposed underneath the cleaning section with the drying fabric loop running therebetween. At one end of the loop, the paper web is formed on or transferred to the drying fabric in the forming section. At the other end of the loop, the fabric passes through the dewatering or drying section and/or the nip at the Yankee dryer. Where a Yankee dryer is used in a paper making machine, the rotations of the loop and the Yankee dryer (which is a rotatable drying cylinder) are coordinated such that the web is transferred to the Yankee dryer and carried over the top thereof in an upright orientation before being creped by the doctor blade. Creping the web in an upright orientation requires the web leaving the pre-drying section to encounter an upwardly moving surface of the Yankee dryer at the nip. Once dried by the Yankee dryer and creped, the dried web is transported to the reel-up to be wound onto a spool.

Prior art paper making machines exhibit some disadvantages resulting from the basic layout described. For example, the typical configuration wherein the cleaning section is above the drying section means that, for the most part, the wet web is transferred from the forming section to the fabric, and transported through the drying section to the nip, on the bottom surface of the fabric. That is, the web is in contact with the fabric, but the fabric does not support the web against the force of gravity. As such, there exists the possibility that the web may fall off the fabric during this "inverted" web run. In addition, with the cleaning section typically disposed above the drying section, elaborate catch pans and measures to prevent condensation must be implemented to prevent cleaning water from dripping from the cleaning section onto the underlying drying section. Water dripping from the cleaning section generally poses a problem in paper making processes involve special fabrics, such as TAD fabrics or other texturing fabrics used in tissue manufacturing which typically have an open structure and are more sensitive to water drip. These disadvantages are inherent in these prior art paper making machines and apply regardless of the type of dryer used in the drying section.

Further, the dewatering or drying section may include, for example, one or more through-air dryers (such as a flat bed dryer, a rotary roll dryer with inward air flow, or a rotary roll dryer with outward air flow) for dewatering or drying the web. Where a through-air dryer is present, a hood is also generally included and typically covers the travel path of the web about the dryer. Accordingly, in prior art paper making machines employing an inverted web run and a through-air dryer having the hood located underneath, there exists the possibility of the web falling off the fabric, jamming in the hood, and thereby causing damage to the dryer.

An example of a prior art paper making machine as described above is found in U.S. Pat. No. 5,611,890 to Vinson et al. which discloses a paper making machine, wherein the wet paper web is transferred to the fabric from a former. The web is then carried underneath and past a vacuum dewatering box and blow-through predryers before being directed upward and transferred to the Yankee dryer at the nip. The fabric then continues upward to be cleaned and dewatered, thus completing its loop by passing over and around showers and a vacuum dewatering box. Similarly, U.S. Pat. No. 5,529,664 to Trokhan et al., U.S. Pat. No. 5,776,307 to Ampulski et al., U.S. Pat. No. 5,364,504 to Smurkoski et al., U.S. Pat. No. 5,701,682 to Chuang et al., and U.S. Pat. No. 5,700,352 to Vinson et al. all disclose paper making machines similar to that described in the Vinson et al. '890 patent.

Thus, it would be desirable to provide a paper making machine configured such that the wet paper web is transported on the fabric and through the drying section on an upper surface of the fabric, such that the fabric supports the web and lessens the possibility of the web falling therefrom. In addition, it would be desirable to provide a machine configured such that the cleaning section is not located above the drying section, thus obviating the need for elaborate means for preventing the cleaning water from dripping from the cleaning section onto the underlying drying section. It would be further desirable to provide a paper making machine with a non-inverting web run through the drying section having a through-air dryer with a hood located thereunder, such that the web will not likely jam in the hood and cause damage to the dryer.

SUMMARY OF THE INVENTION

The above and other needs are met by the present invention which, in one embodiment, provides a paper making machine comprising a water-removing section for increasing the dry solids content of the wet paper web, and a continuous fabric forming a loop such that the fabric passes through the water-removing section, the fabric loop being configured to receive the wet paper web at a web-receiving region of the fabric loop located before the water-removing section and to support and transport the web along an upper portion of the fabric loop through the water-removing section such that the web is generally on an upper surface of the fabric. The fabric loop further includes a web-transfer point at which the web is separated from the fabric and a return run over which the fabric travels from the web-transfer point to the web-receiving region. The apparatus also includes a cleaning section for cleaning the fabric, the cleaning section being located along the return run of the fabric loop and being disposed such that the cleaning section is not above the upper portion of the fabric loop on which the web is supported. Thus, any water that may drip down from the cleaning section will not drip onto the web or the part of the fabric loop on which the web is supported as it is carried through the water-removing device or devices.

In certain preferred embodiments of the invention, the water-removing devices can include pre-dryers for partially drying the wet web, followed by a final dryer for performing final drying of the web. For example, one or more through-air dryers can be provided for pre-drying the web. Final drying can be performed on a Yankee dryer, in which case the web is transferred from the continuous fabric onto the Yankee dryer by passing the fabric and web through a nip formed between a transfer roll and the Yankee dryer. Advantageously, the fabric, after passing through the nip, can be routed so as to travel a return run that includes a generally downward-running portion from the nip and a generally horizontally running portion leading back toward the web-receiving region of the fabric loop. The cleaning section preferably is disposed along one or both of the downward-running portion and the horizontally running portion of the return run of the fabric loop.

In other preferred embodiments of the invention, the water-removing devices can comprise one or more non-compacting dryers, such as through-air dryers, impingement dryers, infrared dryers, contact dryers, or the like, and the Yankee dryer can be eliminated. In this case, the fabric carries the web through the non-compacting dryer or dryers, and then the web is separated from the fabric at a web transfer point of the fabric loop. The web can then be passed to further devices, such as reel-up for winding the web into a roll. The fabric travels from the web transfer point along a return run back to the web-receiving portion of the loop. The return run can include a downward-running portion and a horizontally running portion, and the cleaning section preferably is located along one or both of said portions. Where the web is to be wound into a roll, a reel-up can be provided. The reel-up advantageously can be located above the upper portion of the fabric loop, below the return run of the fabric loop, or beside the fabric loop after the web-transfer point.

Thus, it will be appreciated that the invention enables a wet web to be supported on an upper surface of a continuous fabric loop and carried on the fabric through dryers and/or other water-removing devices, and the fabric can be cleaned after the web is transferred from the fabric, in such a way that the cleaning section is not located above any part of the web. Accordingly, there is no need for elaborate means for preventing the cleaning water from dripping from the cleaning section onto the web, as is necessary in prior art paper making processes employing a cleaning section above the drying section. The elimination of the possibility of dripping onto the fabric and web is especially advantageous in paper making machines employing special texturing fabrics or through-air drying fabrics. In addition, since the web is transported on generally an upper surface of the fabric through the water-removing devices, the sense of the rotation of the fabric is reversed with respect to prior art devices in which the web is carried by a fabric over an inverted run of the fabric. In preferred embodiments of the invention employing a Yankee dryer for final drying, the reversed rotation of the fabric enables the sense of rotation of the Yankee dryer to also be reversed relative to conventional machines, and this in turn enables a reel-up to be located above the upper portion of the fabric loop on which the web is carried, if desired. Further, since the web is carried on top of the fabric in a non-inverting web run, even where the drying section includes a dryer with a hood located thereunder, the web is not likely to separate from the fabric and jam in the hood, thereby lessening the risk of damage to the machine. It will be recognized, therefore, that the invention facilitates the achievement of a number of distinct advantages over prior paper making devices.

BRIEF DESCRIPTION OF THE DRAWINGS

Some of the advantages of the present invention having been stated, others will appear as the description proceeds, when considered in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
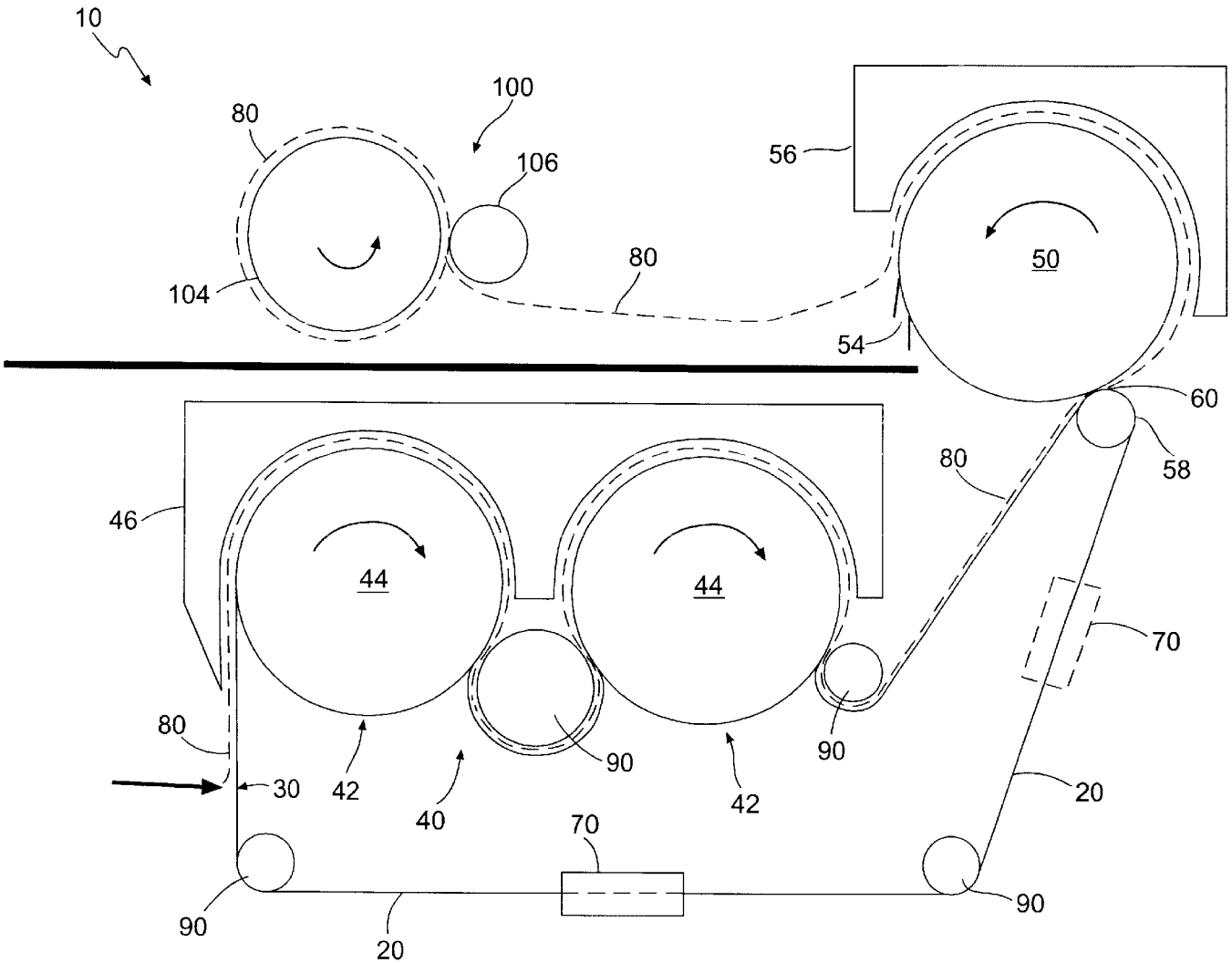
FIGS. 1–3 are schematic representations illustrating several alternative embodiments of the present invention having a pre-drying section followed by a Yankee dryer.

FIG. 1 discloses an embodiment of an apparatus for drying a wet web of paper, more particularly a paper making machine, indicated generally by the numeral 10, which includes the features of the present invention. The machine 10 generally comprises a drying fabric 20, a wet web-receiving region 30, a pre-drying section 40, a Yankee dryer 50, a nip 60, and a cleaning section 70.

The drying fabric 20 forms an endless loop between the wet web-receiving region 30, the pre-drying section 40, the nip 60, and the cleaning section. The fabric 20 may also have a plurality of turning rolls 90 disposed around the fabric 20 in order to guide the fabric 20. The wet web-receiving region 30 is the point on the fabric 20 at which a wet paper web 80 is transferred onto the fabric 20. The wet paper web 80 is typically formed in a forming section (not shown) by a former (not shown), by various methods which are well known in the art. Such formers include, for example, a modified Crescent former wherein the web 80 is formed between a pair of forming fabrics, in which case the web 80 typically is transferred from one of the forming fabrics onto the drying fabric 20 at the web-receiving region 30. Alternatively, the web 80 may be formed directly on the drying fabric 20 such that the web 80 is not actually "transferred" onto the drying fabric 20. Nevertheless, references herein to the wet paper web 80 being transferred to or received by the fabric 20 are intended to include either of the above-described types of machines.

The fabric 20 receives and transports the web 80 to the pre-drying section 40 having at least one dryer 42 for partially drying the wet web 80. In order to produce a web 80 which is soft and absorbent, yet strong, while also using a minimum of paper fiber, a non-compacting dryer preferably is used. Typical non-compacting dryers include through-air dryers, infrared dryers, impingement dryers, and cylindrical contact dryers. Where the drying section utilizes through-air dryers, the through-air dryers may be, for example, flat bed dryers, rotary roll dryers with inward air flow, or rotary roll dryers with outward air flow. Through-air dryers also generally include a hood covering the travel path of the web. It should be understood, however, that the present invention is not limited to machines employing non-compacting dryers, but can also include machines employing a press-type dryer may instead of, or in addition to, a non-compacting dryer.

The embodiment of the present invention shown in FIG. 1 includes a pre-drying section 40 comprising two rotary through-air dryers 42 and a turning roll 90 disposed therebetween. At least one turning roll 90 is used between successive dryers 42 in the pre-drying section 40 having multiple dryers 42 in order to keep the web 80 in the proper orientation with respect to the dryers 42. The through-air dryer 42 generally comprises a rotatable porous cylinder 44 and a hood 46. The hood 46 generally covers the portion of the surface of the porous cylinder 44 about which the web 80 is wrapped and thus is generally located above the porous cylinder 44. Where multiple through-air dryers 42 are used in the pre-drying section 40, the through-air dryers 42 may share a common hood 46. Further, the hood 46 may be constructed as a one piece assembly or may be formed in at least two pieces which are movable away from the porous cylinder 44 to permit access thereto.

Another aspect of the through-air dryer 42 is that, depending on the configuration of the machine 10 and the orientation of the web 80 with respect to the fabric 20 moving through the through-air dryer 42, the through-air dryer 42 may be configured to blow air inward from outside the cylinder or to blow air outward from inside the cylinder. A through-air dryer 42 configured to blow air inward from outside the cylinder, as illustrated in FIG. 1, is preferred where the fabric 20 contacts the porous cylinder 44 and the web 80 lies outside the fabric 20.

Although the fabric 20 carries the web 80 in a circuitous route around the through-air dryers 42, the pre-drying section 40 is generally disposed along the upper portion of the fabric loop 20 and the web 80 is transported generally on the upper surface of the fabric 20 from the wet web-receiving region 30 to the nip 60. Thus, since the web 80 is continuously supported by the fabric 20, the risk of the web 80 falling off or separating from the fabric 20 is reduced as compared to prior art paper making machines having inverted web runs. The "non-inverting" web run through the pre-drying section 40 is also advantageous in embodiments of the present invention where the pre-drying section 40 includes a through-air dryer 42. With through-air dryers 42, the hood 46 typically covers the travel path of the web 80 through the dryer 42. Accordingly, due to the preferred non-inverting web run, the hood 46 is located above the porous cylinder 44 where the pre-drying section 40 has a rotary through-air roll dryer 42 with an inward air flow (wherein the web 80 is separated from the porous cylinder 44 by the fabric 20). Thus, the web 80 is not likely to fall off the fabric 20 and jam in the hood 46, thereby lessening the risk of damage to the through-air dryer 42.

Once the web 80 is transported through the pre-drying section 40 and partially dried to increase the dry solids content thereof, it is transported by the fabric 20 to the Yankee dryer 50 for final drying. The Yankee dryer 50 is a large diameter drum internally heated with steam to provide a hot surface for completing the drying of the web 80. The Yankee dryer 50 typically is also employed to shorten the web 80 in the maching direction so as to make it thicker, bulkier, and extensible in the machine direction, in a process known as creping which is accomplished by a doctor blade 54 that, on removal of the web 80 from the Yankee dryer 50, creates a multitude of microfolds extending in the cross-machine direction. The Yankee dryer 50 further includes a hood 56 partially surrounding the Yankee dryer 50, along the portion about which the web 80 is wrapped. Engaged against the Yankee dryer 50 is a transfer roll 58, forming a nip 60 therebetween, through which passes the fabric 20 carrying the partially dried web 80. The transfer roll 58 presses the web 80 against the Yankee dryer 50 such that the web 80 is transferred to the Yankee dryer 50 from the fabric 20. Once transferred to the Yankee dryer 50, the web 80 is further dried and is then creped from the Yankee dryer 50 by the doctor blade 54.

Note that in the configuration of a paper making machine 10 including a Yankee dryer 50, the Yankee dryer 50 must rotate in the direction opposite to the travel of the fabric loop 20 in order for the fabric 20 and the web 80 to be passed through the nip 60. Accordingly, the Yankee dryer 50 is disposed with respect to the pre-drying section 40 such that the Yankee dryer 50 carries the web 80 over the top of the Yankee dryer 50 to the doctor blade 54 in the opposite direction to which the web 80 traveled through the pre-drying section 40. As the web 80 is creped and separated from the Yankee dryer 50 by the doctor blade 54, it is directed to a reel-up 100. The reel-up 100 generally comprises a spool 104 forming a nip with a drum 106 wherein the web 80 is forwarded therebetween and wound onto the spool 104. The web 80 may run in a free draw (unsupported) between the Yankee dryer 50 and the reel-up 100 or may be supported by a supporting structure (not shown) such as, for example, active air foils. However, the reel-up 100 may be configured in any manner suitable for receiving and gathering the web 80 consistent with the spirit and scope of the present invention.

At the nip 60, the fabric 20 has completed transporting the web 80 from the wet web-receiving region 30 to the Yankee dryer 50. However, since the fabric 20 forms a continuous loop, it must then return to the wet web-receiving region 30 once it exits the nip 60. Since the fabric 20 has already carried a portion of the paper web 80 through the pre-drying section 40 to the nip 60, it must be cleaned of any residue left thereon by the paper web 80 before returning to the wet web-receiving region 30. Accordingly, a cleaning section 70 is disposed along the return run of the fabric loop such that the cleaning section 70 is not above any portion of the web, and particularly is not above the pre-drying section 40, such that the fabric 20 may be cleaned without cleaning water dripping onto the fabric 20 and the web 80 traveling through the pre-drying section 40. Thus, as the fabric 20 exits the nip 60, it travels through the cleaning section 70 which generally comprises a device for washing the fabric 20 such as a shower (not shown) and a device for dewatering the fabric 20 such as a vacuum box (not shown). However, some special types of paper making processes involve special fabrics, such as TAD fabrics or other texturing fabrics used in tissue manufacturing which typically have an open structure and which also require cleaning through the entire thickness of the fabric, that require special and often complicated cleaning equipment. Further, the cleaning section may also comprise a plurality of cleaning stations for cleaning the fabric 20. In addition, the cleaning stations in the cleaning section may be disposed in any orientation consistent with the operation of the specific cleaning equipment used and the travel path of the fabric 20. As indicated in solid lines in FIG. 1, the cleaning section 70 may be located along a generally horizontally running portion of the fabric return run. Alternatively or additionally, as indicated in dashed lines, the cleaning section 70 may be located along a generally downward-running portion of the fabric return run.

After the fabric 20 is cleaned in the cleaning section or sections 70, it completes the loop by returning to the wet web-receiving region 30 where it receives more of the wet paper web 80 to begin the cycle anew. Thus, another advantage provided by embodiments of the present invention having the cleaning section 70 disposed at least not above the pre-drying or drying section 40 is that elaborate catch pans and measures to prevent condensation are not necessary to prevent cleaning water from the cleaning section from dripping onto the pre-drying or drying section 40, whereas such measures are needed with prior art paper making machines having the cleaning section disposed above the pre-drying or drying section.

Figure 2:
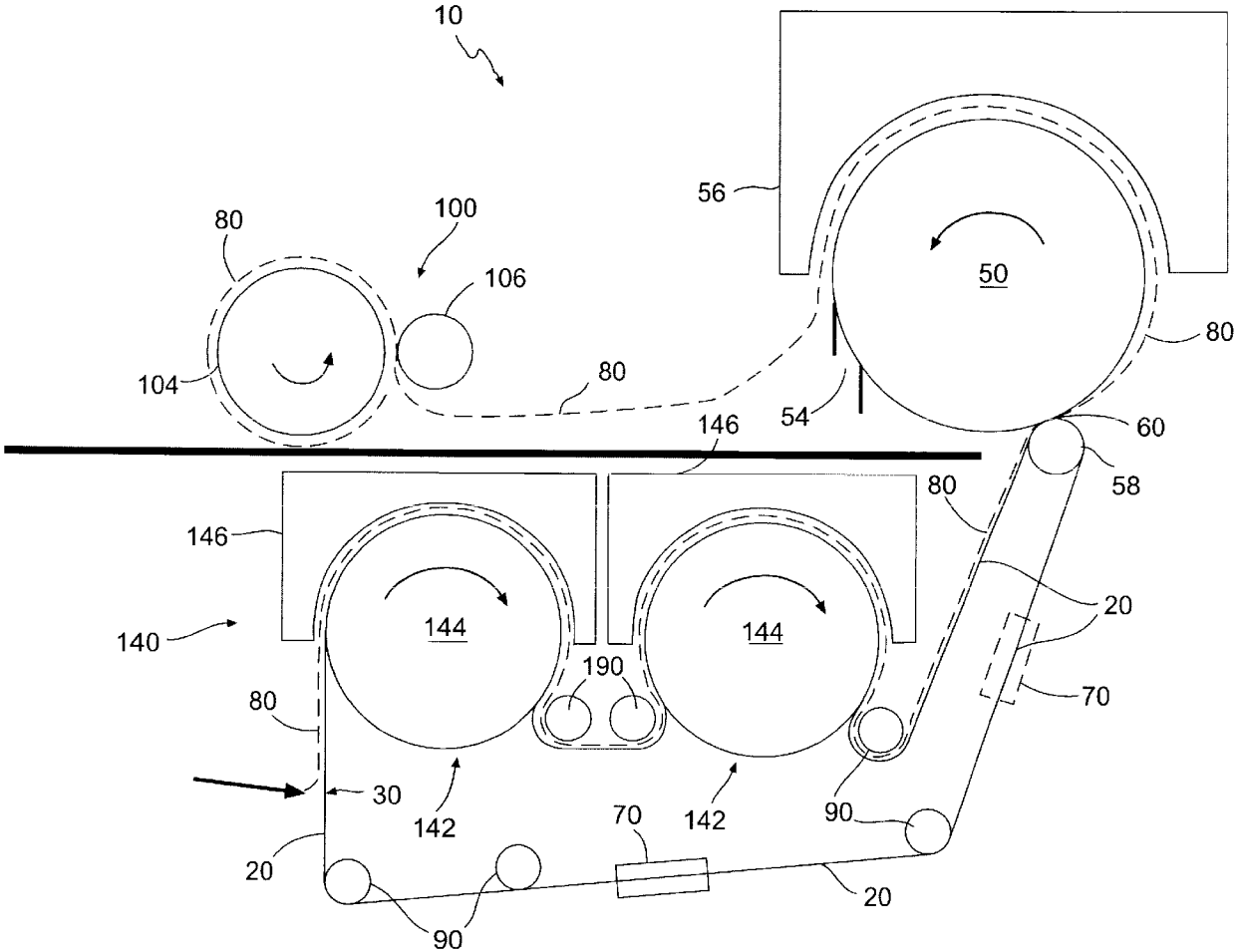

FIG. 2 shows an alternate embodiment of the present invention having two turning rolls 190 between successive through-air dryers 142. This configuration, as with the single turning roll configuration shown in FIG. 1, keeps the web 80 on top of the fabric 20 through the pre-drying section 140. Further, this embodiment shows the through-air dryers 142 each having an individual hood 146. The hoods 146 may each be constructed as a one piece assembly or may be formed in at least two pieces which are movable away from the porous cylinders 144 to permit access thereto.

Figure 3:
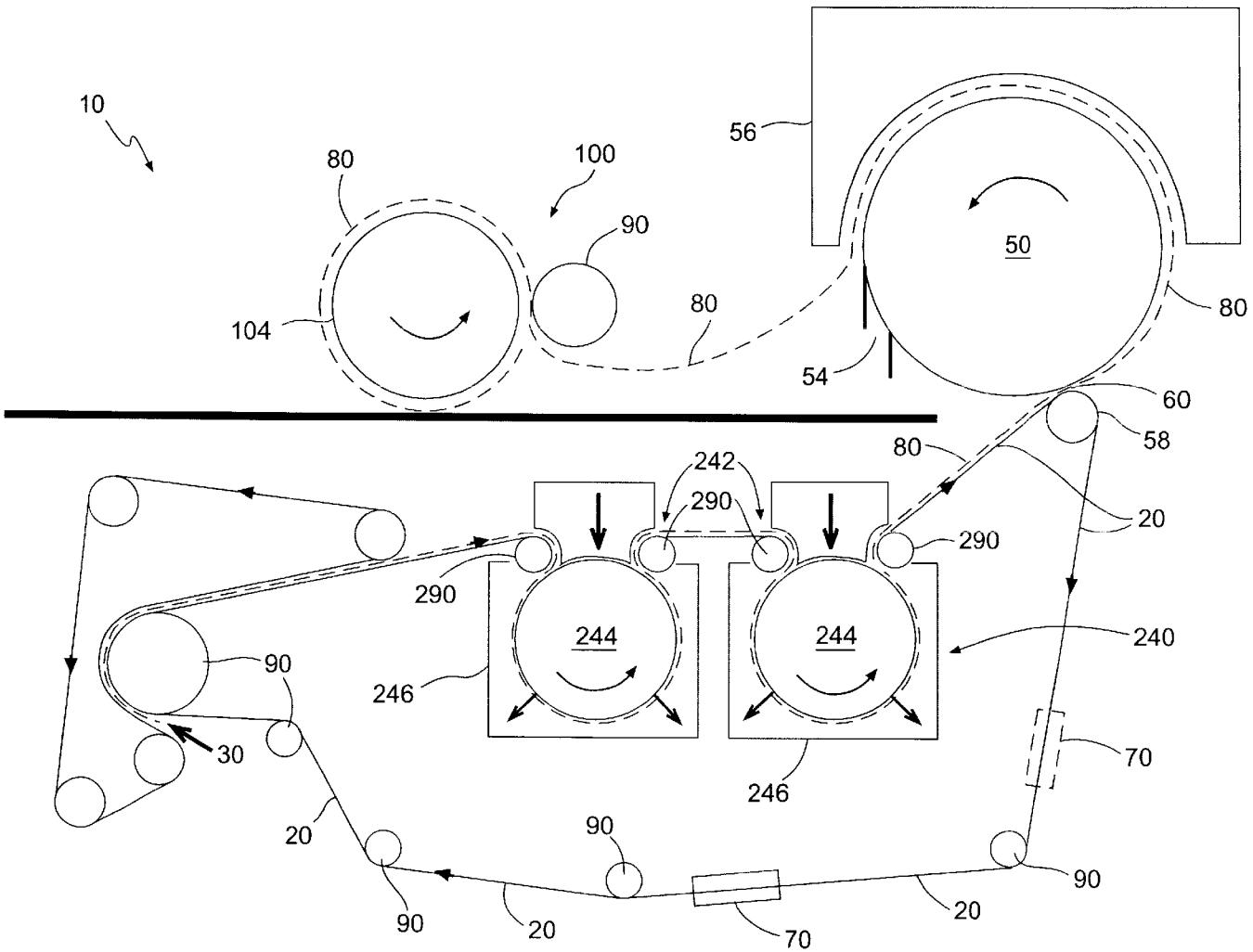

FIG. 3 shows an alternate embodiment of the present invention where the fabric 20 lies outside the web 80 and the web 80 itself contacts the porous cylinders 244 of the through-air dryers 242 in the pre-drying section 240. In this embodiment, it is preferred to have outward airflow from inside the cylinder and the through-air dryers 242 are configured accordingly. Further, this embodiment shows the through-air dryers 242 each having an individual hood 246, with the hoods 246 located below the porous cylinders 244. The hoods 246 may each be constructed as a one piece assembly or may be formed in at least two pieces which are movable away from the porous cylinders 244 to permit access thereto. In addition, this embodiment includes two turning rolls 290 between successive through-air dryers 242. Two further turning rolls 290 are provided at both the entrance into and the exit from the through-air dryers 242 to guide the fabric 20.

Figure 4:
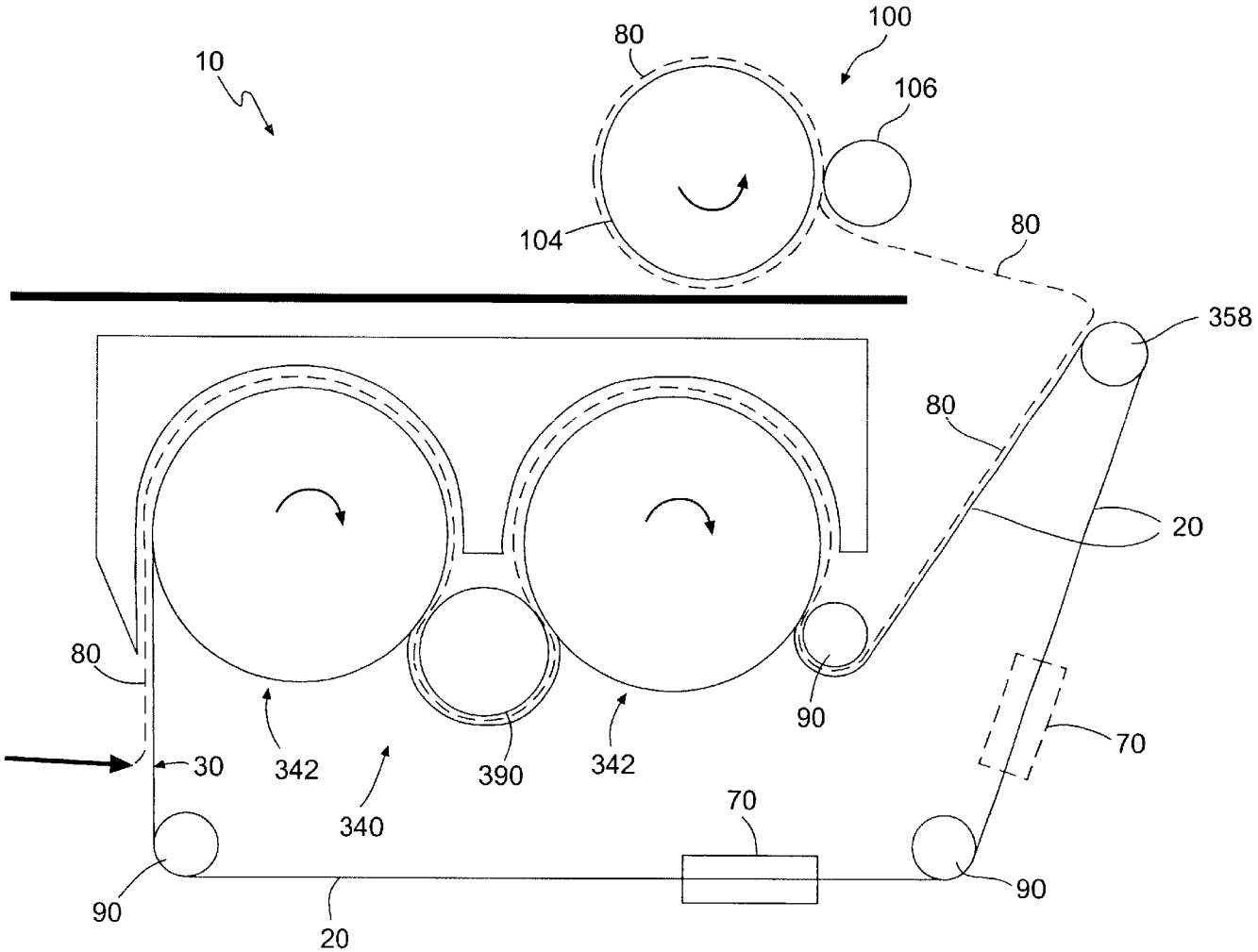
FIGS. 4–8 are schematic representations illustrating still further alternative embodiments of the present invention having a drying section without a Yankee dryer.
Figure 5:
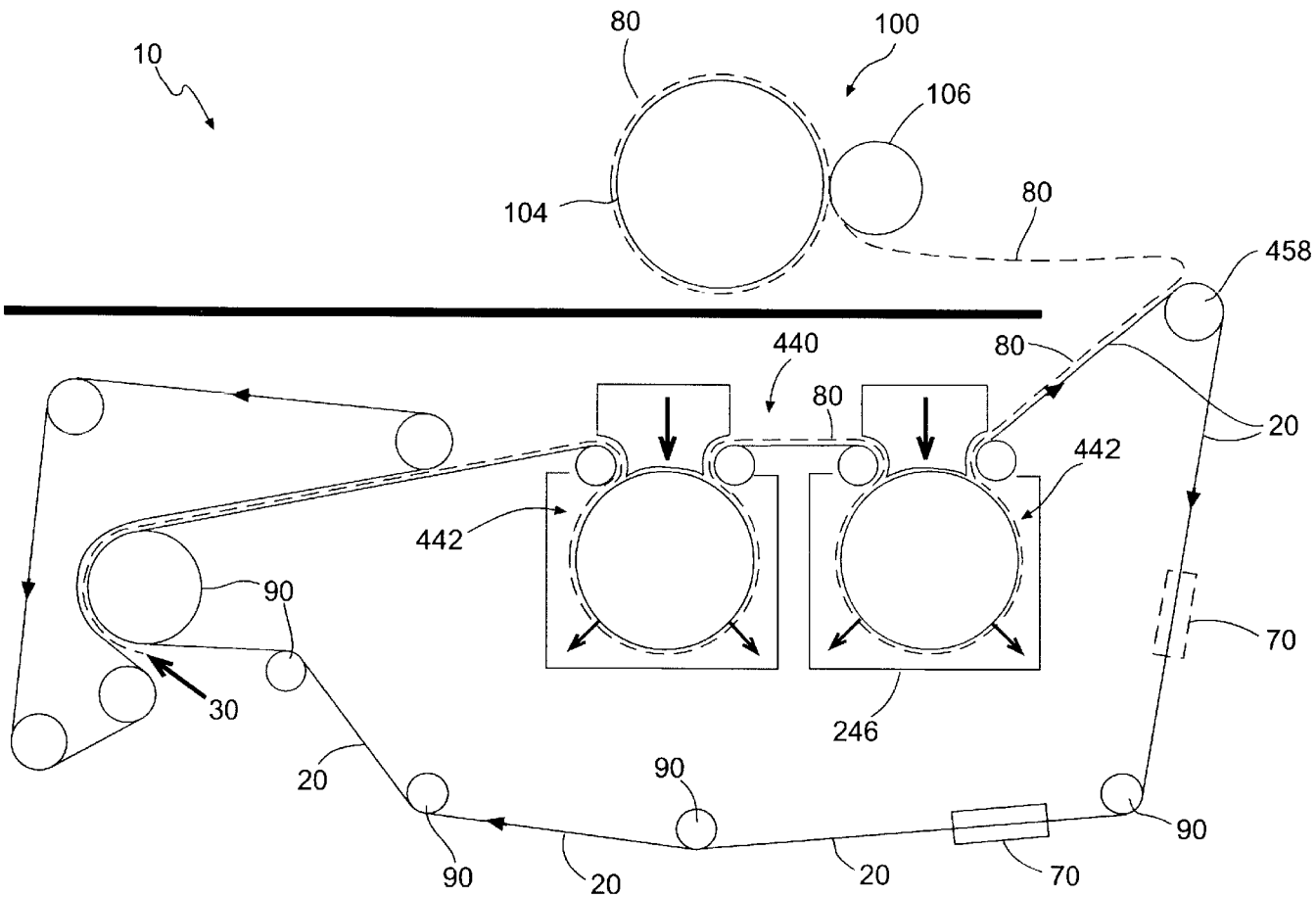
Figure 6:
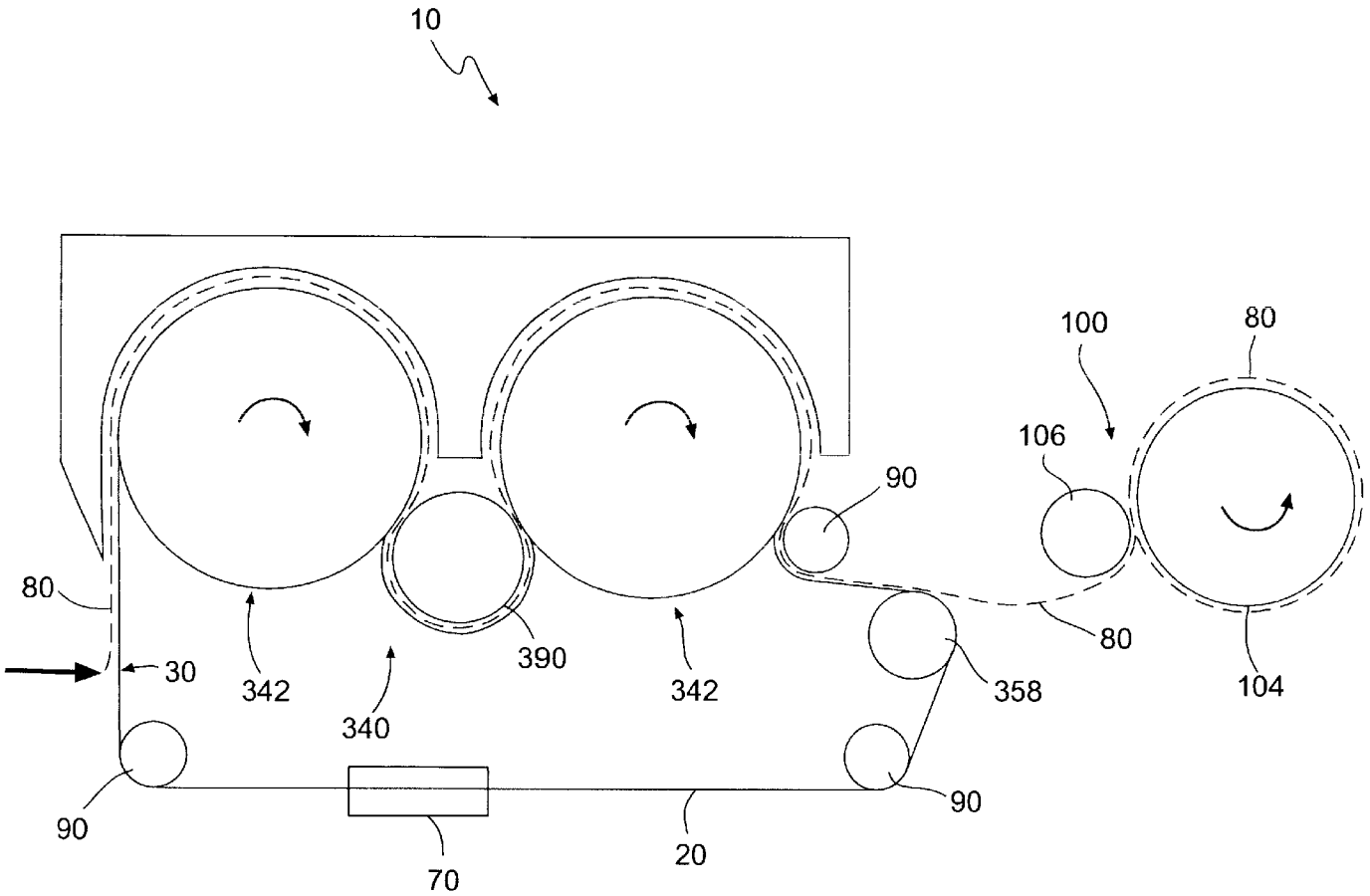
Figure 7:
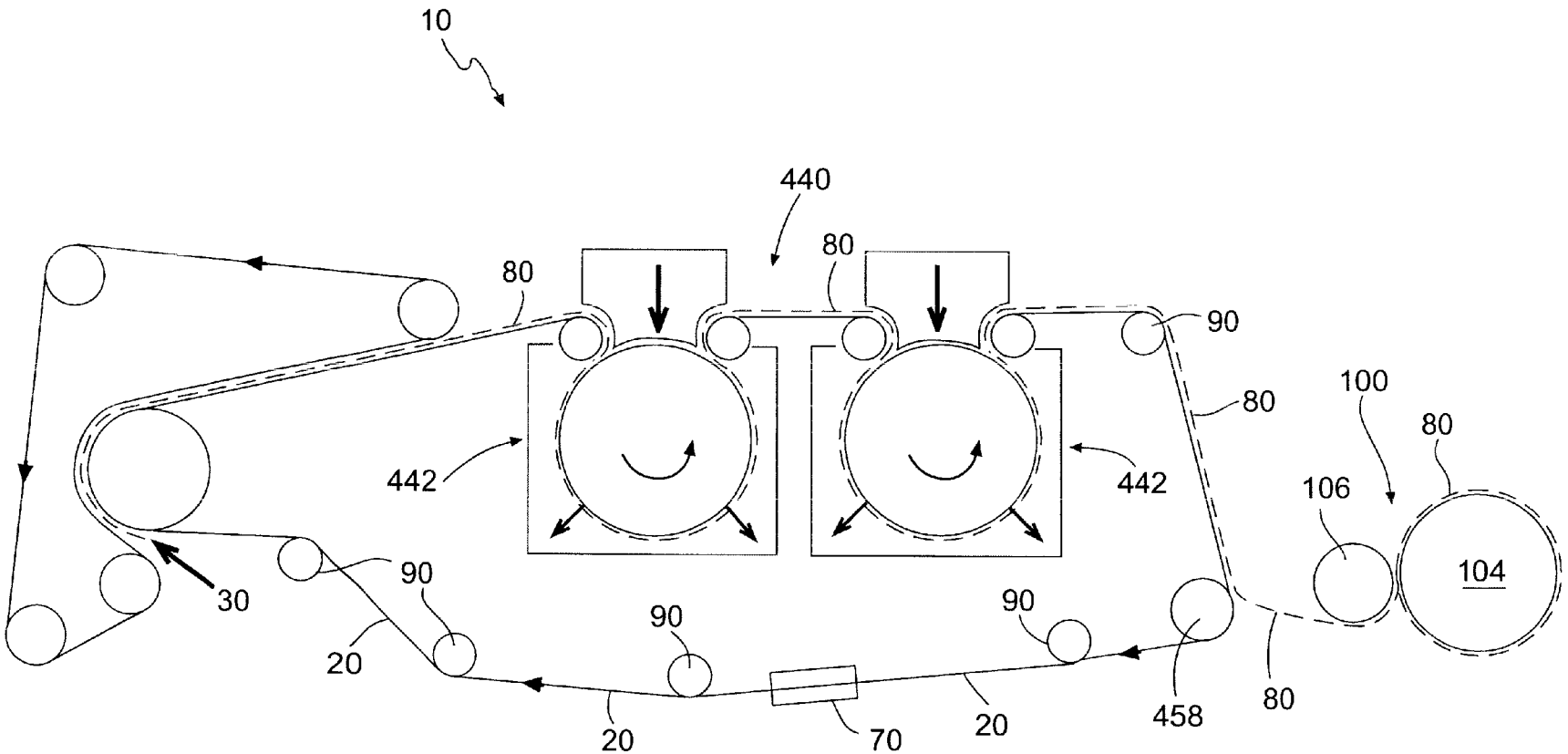
Figure 8:
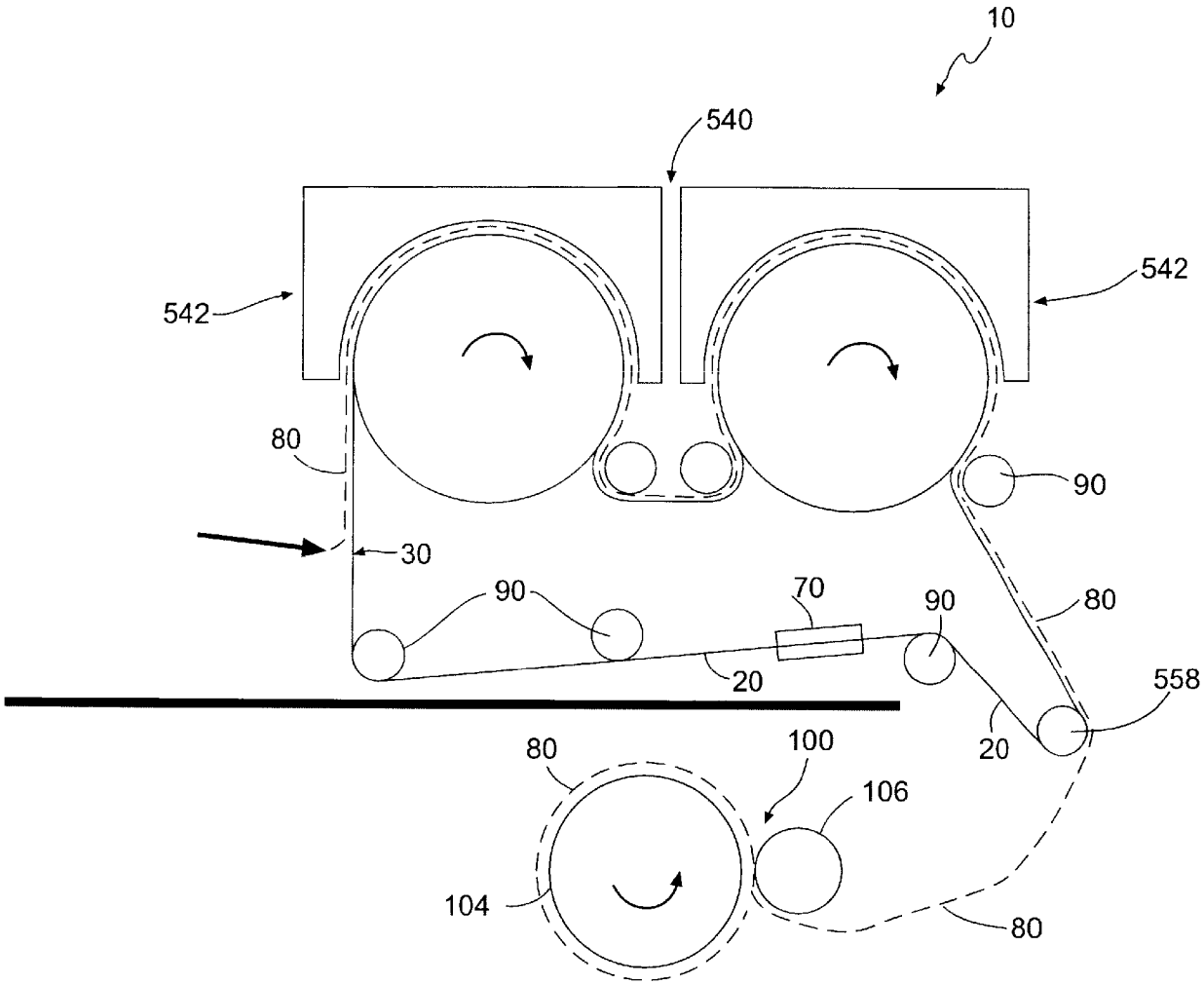

FIGS. 4 through 8 illustrate alternate embodiments of the present invention where a Yankee dryer is not used in the paper making machine 10. Accordingly, the dryers used to increase the dry solids content of the wet paper web 80 become the final dryers of the web 80 and together comprise a drying section. Further, the paper making machine 10 may be configured without the constraints imposed by the inclusion of a Yankee dryer. FIG. 4 shows one embodiment of the present invention wherein the drying section 340 comprises a pair of inward flow through-air dryers 342 separated by a turning roll 390. After the web 80 passes through the drying section 340, the web 80 is transported by the fabric 20 about a turning roll 358 where it is separated from the fabric 20 by, for example, a pick-up shoe (not shown) or a vacuum roll (not shown) and then directed to the reel-up 100. FIG. 5 illustrates an alternate embodiment wherein the drying section 440 comprises a pair of outward flow through-air dryers 442. After the web 80 passes through the drying section 440, it is separated from the fabric 20 and directed to the reel-up 100. Note that both FIGS. 4 and 5 illustrate the reel-up disposed at a level above the drying section. FIGS. 6 and 7 are alternate embodiments of the present invention corresponding to FIGS. 4 and 5, respectively, wherein the drying sections are similarly configured, but the reel-up 100 is disposed at about the same level as the drying section. Further, FIG. 8 shows an alternate embodiment wherein the drying section 540 comprises a pair of inward flow through-air dryers 542. After the web 80 passes through the drying section 540, it is separated from the fabric 20 at a turning roll 558 and directed to the reel-up 100 disposed at a level below the drying section 540.

Figure 9:
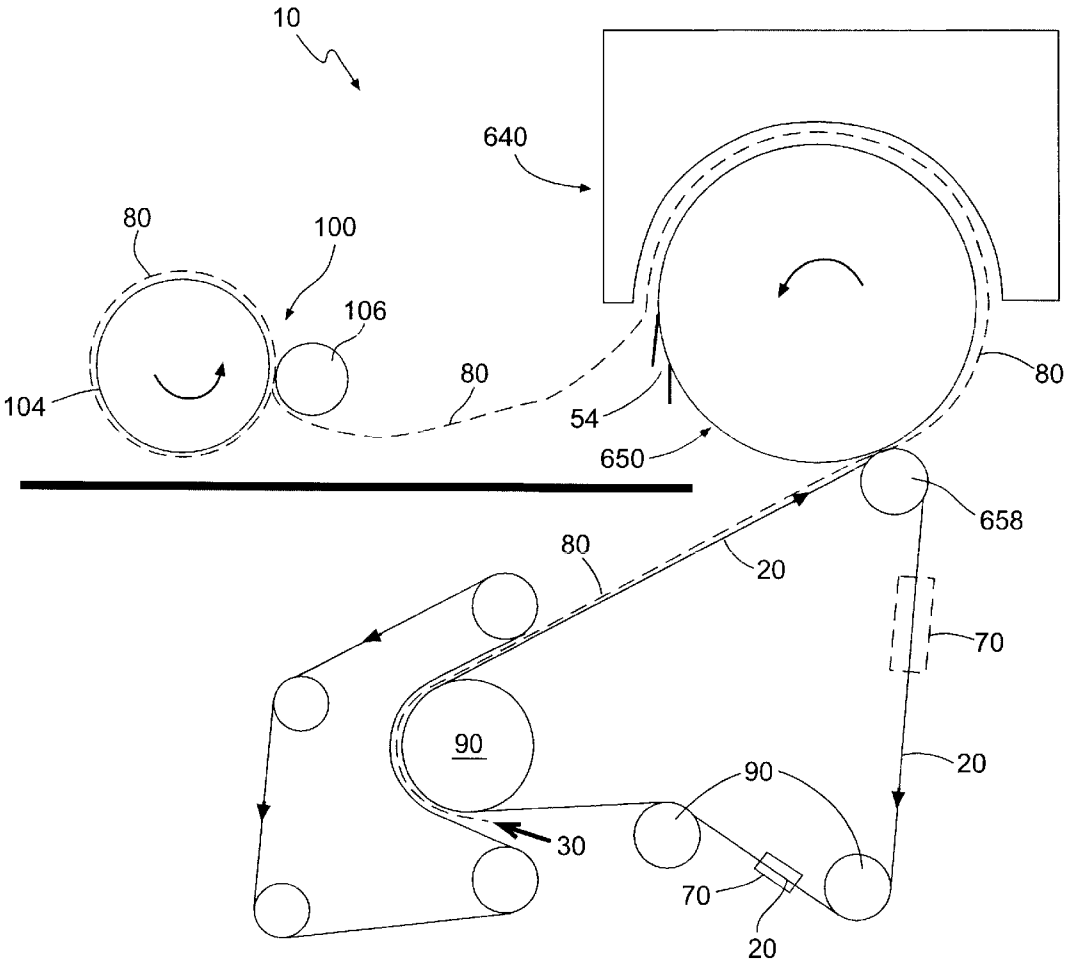
FIG. 9 is a schematic representation illustrating yet another embodiment of the present invention having a Yankee dryer without a pre-drying section.

FIG. 9 illustrates still another alternate embodiment of the present invention wherein the drying section 640 comprises a Yankee dryer 650 without a preceding pre-drying section. In this embodiment, the web 80 may be somewhat dewatered by the fabric 20 before being transferred to the Yankee dryer 650, but the Yankee dryer 650 dries the web 80 to the desired dry solids content before the web 80 is directed to the reel-up 100 and is the final dryer in this instance.

Thus, embodiments of the present invention provide a paper making machine wherein the cleaning section is disposed at least not above the pre-drying or drying section, thereby obviating the need for elaborate means for preventing cleaning water from the cleaning section from dripping onto the underlying drying section, as necessary in prior art paper making processes where the cleaning section is disposed above the drying section. In addition, the rotation of the fabric is reversed with respect to the prior art and the web is transported on generally an upper surface of the fabric in a non-inverting web run through the pre-drying or drying section. Therefore, with the fabric supporting the web, there is less chance of the web falling off the fabric as it is being transported. Further, the non-inverting web run lessens the possibility of the web falling off the fabric and jamming in an underlying hood of a dryer, and therefore lessens the risk of damage to a dryer configured in this way.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. For example, while preferred embodiments of the invention have been described having a reel-up disposed vertically above a drying section, the invention is applicable to machines in which the reel-up is not disposed above the drying section. Although specific terms are employed herein, they are used in a generic and descriptive sense only and not for purposes of limitation.

What is claimed is:

1. An apparatus for drying a wet web of tissue paper, said apparatus comprising:

a drying section for drying the wet tissue paper web;

a single continuous fabric forming a loop such that only the single fabric passes through the entire drying section, the fabric loop being configured to receive the wet tissue paper web at a web-receiving region of the fabric loop located before the drying section, the fabric being configured to support and transport the web along an upper portion of the fabric loop through the drying section in such a manner that the web is generally on an upper surface of the fabric, the fabric loop further including a web-transfer point at which the web is separated from the fabric and a return run over which the fabric travels from the web-transfer point to the web-receiving region; and a cleaning section for cleaning the fabric, the cleaning section being located along the return run of the fabric loop and being disposed such that the cleaning section is not above the upper portion of the fabric loop on which the web is supported.

2. The apparatus according to claim 1, wherein the drying section comprises at least one non-compacting dryer.

3. The apparatus according to claim 1, wherein the drying section comprises at least one of a through-air dryer, an infrared dryer, an impingement dryer, a contact dryer, and a Yankee dryer.

4. The apparatus according to claim 1, wherein the cleaning section is disposed along a lower portion of the fabric loop that passes below the upper portion thereof.

5. The apparatus according to claim 1, wherein the cleaning section is disposed below the water-removing section.

6. The apparatus according to claim 1, wherein the return run of the fabric loop includes a generally downward-running portion of the loop from the web transfer point and a generally horizontally running portion leading toward the web-receiving region, and wherein the cleaning section is located along at least one of the generally downward-running portion and the generally horizontally running portion of the loop.

7. The apparatus according to claim 1, further comprising a reel-up located after the web transfer point.

8. The apparatus according to claim 7, wherein the reel-up is located above said at least one through-air dryer.

9. The apparatus according to claim 7, wherein the reel-up is located below said at least one through-air dryer.

10. A method of drying a wet web of tissue paper, said method comprising:

receiving the wet tissue paper web at a web-receiving region on an upper surface of a single continuous drying fabric arranged to travel about a loop, the fabric being configured to support and transport the web thereon;

transporting the wet paper web, with only the single fabric, along an upper portion of the loop, through a drying section for drying the wet tissue paper web, and to a web transfer point in such a manner that only the single fabric passes through the entire drying section;

separating the web from the fabric at the web transfer point; and cleaning the fabric in a cleaning section disposed along a return run of the fabric loop between the web transfer point and the web-receiving region, the cleaning section being located along the return run such that the cleaning section is not above the upper portion of the loop.

11. The method according to claim 10, wherein the transporting step comprises transporting the web through at least one non-compacting dryer.

12. The method according to claim 10 wherein the transporting step comprises passing the web through at least one of a through-air dryer, an infrared dryer, an impingement dryer, and a contact dryer.

13. An apparatus for forming and drying a web of paper, said apparatus comprising:

a forming section for forming a wet web of paper;

a continuous fabric forming a loop, the fabric loop being configured to receive the wet paper web directly from the forming section at a web-receiving region of the loop and to transport the web along an upper portion of the loop such that the web is disposed generally on an upper surface of the fabric and is not compressed, the upper portion of the loop including a transfer roll about which the fabric and web are carried at a downstream end of the upper portion;

a Yankee dryer forming a single nip with the transfer roll such that the web is transferred in the single nip onto the Yankee dryer, the Yankee dryer being operable to finally dry the wet paper web;

a cleaning section for cleaning the fabric after the fabric exits the single nip, the cleaning section being located along a return run of the fabric loop along which the fabric travels back to the web-receiving region, the return run of the fabric loop being configured such that the fabric does not contact the web after the web is transferred therefrom at the single nip and being disposed such that the cleaning section is not above the upper portion of the fabric loop on which the web is carried.

14. The apparatus according to claim 13, wherein the return run of the fabric loop includes a generally downward-running portion of the loop from the nip and a generally horizontally running portion leading toward the web-receiving region, and wherein the cleaning section is located along at least one of the generally downward-running portion and the generally horizontally running portion of the loop.

15. The apparatus according to claim 13, wherein the cleaning section is disposed below the portion of the fabric supporting the web.

16. A method of drying a wet web of paper, said method comprising:

receiving the wet paper web directly from a forming section at a web-receiving region on an upper surface of a continuous drying fabric arranged to travel about a loop, the fabric being configured to support and transport the web thereon;

transporting the wet paper web with the fabric along an upper portion of the loop, without compressing the web, and through a web transfer point defined by a single nip between a Yankee dryer and a transfer roll;

transferring the web from the fabric to the Yankee dryer at the web transfer point; and cleaning the fabric in a cleaning section disposed along a return run of the fabric loop between the web transfer point and the web-receiving region, the return run being configured such that the fabric does not contact the web after the web is transferred therefrom at the single nip, the cleaning section being located along the return run such that the cleaning section is not above the upper portion of the loop.

17. An apparatus for drying a wet web of paper, said apparatus comprising:

a pre-drying section for partially drying the wet paper web;

a Yankee dryer following the pre-drying section and forming a nip with a transfer roll engaged thereagainst, the Yankee dryer being operable to further dry the partially dried paper web;

a continuous fabric forming a loop such that the fabric passes through the pre-drying section and the nip, the fabric loop being configured to receive the wet paper web at a web-receiving region of the fabric loop located before the pre-drying section and to support and transport the web along an upper portion of the fabric loop through the pre-drying section to the Yankee dryer such that the web is generally on an upper surface of the fabric and is transferred from the fabric onto the Yankee dryer as the fabric and web pass through the nip, the fabric then exiting the nip and traveling along a return run of the fabric loop back to the web-receiving region; and a cleaning section for cleaning the fabric, the cleaning section being located along the return run of the fabric loop and being disposed such that the cleaning section is not above the pre-drying section.

18. The apparatus according to claim 17, wherein the pre-drying section comprises at least one of a through-air dryer, an infrared dryer, an impingement dryer, and a contact dryer.

19. The apparatus according to claim 17, wherein the return run of the fabric loop includes a generally downward-running portion of the loop from the Yankee dryer and a generally horizontally running portion leading toward the web-receiving region, and wherein the cleaning section is located along at least one of the generally downward-running portion and the generally horizontally running portion of the loop.

20. The apparatus according to claim 17, wherein the return run of the fabric loop includes a lower portion than passes below the upper portion of the fabric loop, and wherein the cleaning section is disposed along the lower portion of the loop.

21. The apparatus according to claim 17, wherein the cleaning section is disposed below the pre-drying section.

22. A method of drying a wet web of paper, said method comprising:

receiving the wet paper web at a web-receiving region on an upper surface of a continuous drying fabric arranged to travel about a loop, the fabric being configured to support and transport the web thereon;

transporting the wet paper web with the fabric along an upper portion of the loop, through a pre-drying section for partially drying the wet paper web, and through a web transfer point defined by a nip between a Yankee dryer and a transfer roll;

transferring the web from the fabric to the Yankee dryer at the web transfer point, the Yankee dryer being operable to further dry the partially dried paper web; and cleaning the fabric in a cleaning section disposed along a return run of the fabric loop between the web transfer point and the web-receiving region, the cleaning section being located along the return run such that the cleaning section is not above the pre-drying section.

23. A method according to claim 22, wherein transporting the wet paper web further comprises transporting the wet paper web through a pre-drying section comprising at least one non-compacting dryer.

24. A method according to claim 22, wherein transporting the wet paper web further comprises transporting the wet paper web through a pre-drying section comprising at least one of a through-air dryer, an infrared dryer, an impingement dryer, and a contact dryer.

* * * * *